US006307524B1

(12) United States Patent
Britain

(10) Patent No.: US 6,307,524 B1
(45) Date of Patent: Oct. 23, 2001

(54) YAGI ANTENNA HAVING MATCHING COAXIAL CABLE AND DRIVEN ELEMENT IMPEDANCES

(75) Inventor: Kent Britain, Grand Prairie, TX (US)

(73) Assignee: Core Technology, Inc., Valhalla, NY (US)

( * ) Notice: Subject to any disclaimer, the term of this patent is extended or adjusted under 35 U.S.C. 154(b) by 0 days.

(21) Appl. No.: 09/484,055

(22) Filed: Jan. 18, 2000

(51) Int. Cl.[7] ..... H01Q 19/30
(52) U.S. Cl. ..... 343/795; 343/819; 343/830
(58) Field of Search ..... 343/795, 818, 343/819, 829, 830; H01Q 9/28, 19/28, 19/30

(56) References Cited

U.S. PATENT DOCUMENTS

| | | | |
|---|---|---|---|
| 4,812,855 | 3/1989 | Coe et al. | 343/818 |
| 4,849,765 | 7/1989 | Marko | 343/702 |
| 5,061,944 | 10/1991 | Powers et al. | 343/795 |
| 5,220,335 | 6/1993 | Huang | 343/700 MS |
| 5,559,523 | 9/1996 | Smith et al. | 343/795 |
| 5,709,832 | 1/1998 | Hayes et al. | 264/272.11 |
| 5,712,643 | 1/1998 | Skladany | 343/700 MS |
| 5,754,145 | 5/1998 | Evans | 343/795 |
| 5,844,525 | 12/1998 | Hayes et al. | 343/702 |
| 5,896,108 | 4/1999 | Shafai | 343/700 MS |
| 6,046,703 * | 4/2000 | Wang et al. | 343/795 |

FOREIGN PATENT DOCUMENTS 21 38 384 * 10/1982 (DE) ..... 343/819

OTHER PUBLICATIONS

Alvis J. Evans and Kent E. Britain, "Radio Shack Antennas: Selection, Installation and Projects", 4th Edition, © 1998, pp. 11:11–11:14.

CQ VHF Ham Radio Above 50 Mhz, vol. 3, No. 8, Aug. 1998, Kent Britain, "Some Really Cheap Antennas", pp. 57–61.

CQ VHF Ham Radio Above 50 Mhz, vol. 3, No. 10, Oct. 1998, Kent Britain, "More Really Cheap Antennas", pp. 46–50.

CQ VHF Ham Radio Above 50 Mhz, vol. 4, No. 4, Apr. 1999, Kent Britain, "Cheap Circular Polarization? It Can Be Done", pp. 66–69.

Clear Lake Amateur Radio Club, "Cheap Yagi Antennas for VHF/UHF", Kent Britain, http://www.clarc.org/Articles/uh-f.htm.

* cited by examiner

*Primary Examiner*—Michael C. Wimer
(74) *Attorney, Agent, or Firm*—Morgan, Lewis & Bockius LLP

(57) ABSTRACT

A printed Yagi antenna of the present invention has a circuit board, a driven element having an impedance Ωd and being printed on the circuit board, a director element printed on the circuit board, a reflector element printed on the circuit board, a microstrip transmission line, and a coaxial cable having and impedance Ωc. The coaxial cable feeds the driven element via the miscrostrip transmission line and Ωc is approximately equal to Ωd. Further, the spacing between the reflector element, the driven element, and director elements are chosen so that an optimum balance is achieved between directional gain and performance sensitivity. The printed Yagi antenna has a partial folded driven element having a J shape which is grounded at the mid-point of the longest portion of the element. The configuration allows for a coaxial cable to be attached directly to the microstrip transmission line without the use of a matching network or balun.

21 Claims, 8 Drawing Sheets

YAGI ANTENNA HAVING MATCHING COAXIAL CABLE AND DRIVEN ELEMENT IMPEDANCES

BACKGROUND OF THE INVENTION

1. Field of Invention

This invention relates to a Yagi-Uda (Yagi) antenna, and in particular, to a Yagi antenna formed on a printed circuit board having matching coaxial cable and driven element impedances.

2. Discussion of Related Art

The traditional Yagi antenna encompasses a broad class of antennas which usually have one active dipole element (sometimes referred to as the "driven element"), one reflector dipole element, and one or more director dipole elements. A typical arrangement is shown in FIG. 7. The traditional Yagi antenna is constructed with a longitudinal support structure 102 having dipole elements 103–105 arrayed in a fishbone pattern. The support structure 102 can be made from any rigid material including metal. Director elements 105 and reflector element 104 may be attached directly (electrically) to the metallic support structure 102 without affecting the antenna performance since the midpoints of these elements are at a negligible potential. The active dipole element 103, however, is isolated from the metallic support structure. The directional and bandwidth characteristics are determined primarily by the element spacings and lengths. A common arrangement is for the reflector length Lr to be slightly larger than ½λ, and for the director lengths L1–L3 to be slightly less than ½λ.

As shown in FIG. 7, the driven element 103 of a conventional Yagi antenna is typically a simple half-wave dipole or a folded dipole and is driven by a source of electromagnetic energy. The plurality of director elements 105 are disposed on one side of the driven element 103 while the reflector element 104 is disposed on the other side of the driven element 103. The director elements 105 are usually disposed in a spaced relationship in the portion of the antenna pointing in the direction to which electromagnetic energy (radio waves) is to be transmitted, or the direction from which radio waves are to be received. The reflector element 104 is disposed on the side of the driven element 103 opposite from the array of director elements 105.

When the driven element 103 radiates, it induces electrical currents to flow in the parasitic elements 104 and 103 which in turn cause the parasitic elements to re-radiate. If the antenna is being used to transmit, the director elements 105 are positioned so that the radio waves re-radiating from the director elements 105 constructively combine with the radio waves radiating from the driven element 103, thereby focusing the combined radio waves in a specific direction. Thus, the operation of the directors is analogous to the operation of an optical lens.

Conversely, the reflector element 104 is positioned so that it re-radiates radio waves 180° out of phase with the radio waves generated by the driven element 3, thereby creating an electrical null. Thus, the operation of the reflector 104 is analogous to the operation of a mirror. If the antenna is being used to receive radio waves, the director elements 105 focus signals received from a specific direction to the driven element 103 while the reflector element 104 cancels radio waves received from the opposite direction.

The Yagi antenna has been used successfully in applications such as reception of television signals, HAM radio, point-to-point communications, and other applications requiring high directivity or gain in a particular direction. This directivity offers the advantage of increased antenna gain in one direction and decreased antenna gain in other directions. Therefore, weak signals may be received at a higher signal strength by pointing the antenna towards the signal source. Similarly, when used to transmit signals, the Yagi antenna provides increased effective transmit power in a given direction.

An antenna has an input impedance which is usually measured looking into the driven element. Each type of driven element has a particular free space impedance. For example, the impedance of the conventional Yagi antenna at a folded dipole driven element is typically 300 Ω. A standard coaxial cable, used to connect the antenna to a receiver or transmitter, has either a 50 Ω or 72 Ω impedance. If, for example, a 50 Ω cable is connected to a 300 Ω antenna, the impedance mismatch causes a large percentage of the electromagnetic energy to be reflected back toward the energy source thereby decreasing the antenna performance and gain. Therefore, it is desirable to match the antenna impedance to the impedance of the coaxial cable.

One conventional solution to this impedance matching problem is to provide a matching network between the driven element and the antenna cable. Powers et al., U.S. Pat. No. 5,061,944 discloses such a matching network. Furthermore, Powers et al. discloses a particular type of driven element known as a balanced feed. The use of a balanced feed adds the additional requirement that a balance-unbalanced transformer (balun) be inserted between the coaxial cable and the driven element. The requirement of adding an impedance matching network and a balun to the antenna increases component count, cost, and assembly time, and may limit the frequency response of the antenna.

The spacings between the elements of conventional Yagi antennas are dictated primarily by the wavelength λ of the transmitted or received radio waves because the parasitic elements are designed to be a sufficient distance, relative to λ, from the driven element (e.g., a folded dipole) and from other adjacent parasitic elements. Thus, for a given number of directors, the size reduction of the antenna is limited. One approach to overcoming the minimum element spacing required by traditional Yagi antennas is to use a 72 Ω simple dipole and to reduce the spacing between adjacent parasitic elements and between parasitic elements and the driven element. An additional advantage of this approach is that the impedance of the driven element can be reduced to match the impedance of the antenna cable, thus eliminating the need for a matching network.

This impedance reduction is due to the advantageous loading effects on the driven element by the closely coupled parasitic elements. However, the use of the 72 Ω simple dipole does not allow for tightly coupled element spacing and suffers from poor directional gain. While the use of a 300 Ω folded dipole offers better directional gain, this design suffers from extreme sensitivity to small variations in element spacing. Thus, neither the simple dipole nor the folded dipole are optimally used as the driven element to provide good directional gain with tightly coupled elements.

One solution is to use a partial folded J element, having an impedance of 150 Ω, as the driven element as disclosed in the publication "Antennas, Selection, Installation and Projects," Evans and Britain, 1998. The use of the partial folded J element reduces antenna performance sensitivity to small changes in element spacing. The J element provides excellent directional gain due to tight element coupling. More importantly, the J element can be loaded by reducing parasitic element spacing so that its input impedance is substantially equal to the impedance of the coaxial feed cable. Consequently, the feed cable is attached directly to the driven element. However, this design is assembled by hand and is not reliably and repeatably manufactured at low cost, particularly at short wavelengths.

As the tuned frequency of the antenna is increased, the wavelength λ decreases thus requiring smaller and smaller element dimensions and spacing. Because at high frequencies small variations in the length and spacing of the antenna elements cause changes in electromagnetic characteristics, discretely assembled antennas can have significant variations in performance. For example, the conventional Yagi antenna, shown in FIG. 7, has a metallic support structure and the elements are attached by hand via screws, rivets or other attaching means and methods. The variation in the antenna due to hand assembly leads to increased production cost and a low measure of repeatability.

One solution to this inefficient assembly problem is to form the antenna on a printed circuit board, as disclosed in Skladany, U.S. Pat. No. 5,712,643 and Shafai, U.S. Pat. No. 5,896,108. However, the antenna disclosed in Shafai requires a matching network between the driven element and the signal source, thus adding to the component count and cost. The antenna disclosed in Skladany consists of two printed circuit boards with one of the printed circuit boards having a hybrid coupler feed serving as a balun. These extra components add significantly to production cost and assembly time. Furthermore, in the designs disclosed by both Skladany and Shafai, the minimum required spacing between adjacent parasitic elements and between parasitic elements limits a reduction in overall antenna size. For example, the balanced feed of the Skladany antenna does not allow for close coupling of the Yagi elements thereby resulting in an antenna design that is larger than necessary.

One major difficulty in designing a printed antenna is finding a simple and inexpensive method of attaching a coaxial feed cable directly to the antenna elements. One conventional approach requires that the coaxial cable be attached to both the top of the printed circuit board via the coaxial cable's center conductor, and the bottom of the printed circuit board via the coaxial cable's ground mesh. This approach complicates the assembly procedure because a soldering or attaching operation must be performed on both sides of the printed circuit board. Other methods of attaching the coaxial cable to the printed antenna require that the cable be attached to the antenna at a 90° angle relative to the major surface of the printed circuit board, thereby limiting design choices to this particular topology.

SUMMARY OF THE PRESENT INVENTION

An object of the invention is to overcome the aforementioned problems and limitations of conventional Yagi antennas. Another object is to provide a printed circuit Yagi antenna that achieves a good balance between directional gain and size while matching the antenna impedance to the impedance of the coaxial feed line. Another object of the invention is to design a compact directional antenna that does not require a separate matching network, that is capable of being fed directly with a coaxial cable, and can be produced in high volume at low cost. Another object of the invention is to provide a radio receiver system and a transmitter system using the disclosed Yagi antenna.

To achieve these and other advantages and in accordance with the purpose of the present invention, as embodied and broadly described, in one aspect of the invention there is provided a Yagi antenna, comprising an insulative circuit board having a proximal end and a distal end; a driven element having an impedance Ωd and being printed on the circuit board; one or more director elements printed on the circuit board at a position located between the distal end of the circuit board and the driven element; a reflector element printed on the circuit board at a position located between the proximal end of the circuit board and the driven element; a microstrip transmission line printed on the circuit board, the microstrip transmission line having a proximal end, a distal end, and an impedance Ωw, the distal end of the microstrip transmission line being electrically connected to the driven element; a cable having an impedance Ωc, the coaxial cable being electrically connected to the proximal end of the microstrip transmission line, and wherein the impedance Ωc matches the impedances Ωd and Ωw.

In another aspect of the invention there is provided a radio receiver system, comprising a radio receiver having and input and an output; an insulative circuit board having a proximal end and a distal end; a driven element having an impedance Ωd and being printed on the circuit board; one or more director elements printed on the circuit board at a position located between the distal end of the circuit board and the driven element; a reflector element printed on the circuit board at a position located between the proximal end of the circuit board and the driven element; a microstrip transmission line printed on the circuit board, the microstrip transmission line having a proximal end, a distal end, and an impedance Ωw, the distal end of the microstrip transmission line being electrically connected to the driven element; a cable having a first end, a second end, and an impedance Ωc, wherein the first end is electrically connected to the proximal end of the microstrip transmission line, and the second end is electrically connected to the input do of the receiver, and wherein the impedance Ωc matches the impedances Ωd and Ωw.

In another aspect of the invention there is provided a transmitter system, comprising a transmitter having and input and an output; an insulative circuit board having a proximal end and a distal end; a driven element having an impedance Ωd and being printed on the circuit board; one or more director elements printed on the circuit board at a position located between the distal end of the circuit board and the driven element; a reflector element printed on the circuit board at a position located between the proximal end of the circuit board and the driven element; a microstrip transmission line printed on the circuit board, the microstrip transmission line having a proximal end, a distal end, and an impedance Ωw, the distal end of the microstrip transmission line being electrically connected to the driven element; a cable having a first end, a second end, and an impedance Ωc, wherein the first end is electrically connected to the proximal end of the microstrip transmission line, and the second end is electrically connected to the output of the transmitter, and wherein the impedance Ωc matches the impedances Ωd and Ωw.

It is to be understood that both the foregoing general description and the following detailed description are exemplary and explanatory and are intended to provided further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DESCRIPTION OF THE PREFERRED EMBODIMENT

Figure 1:
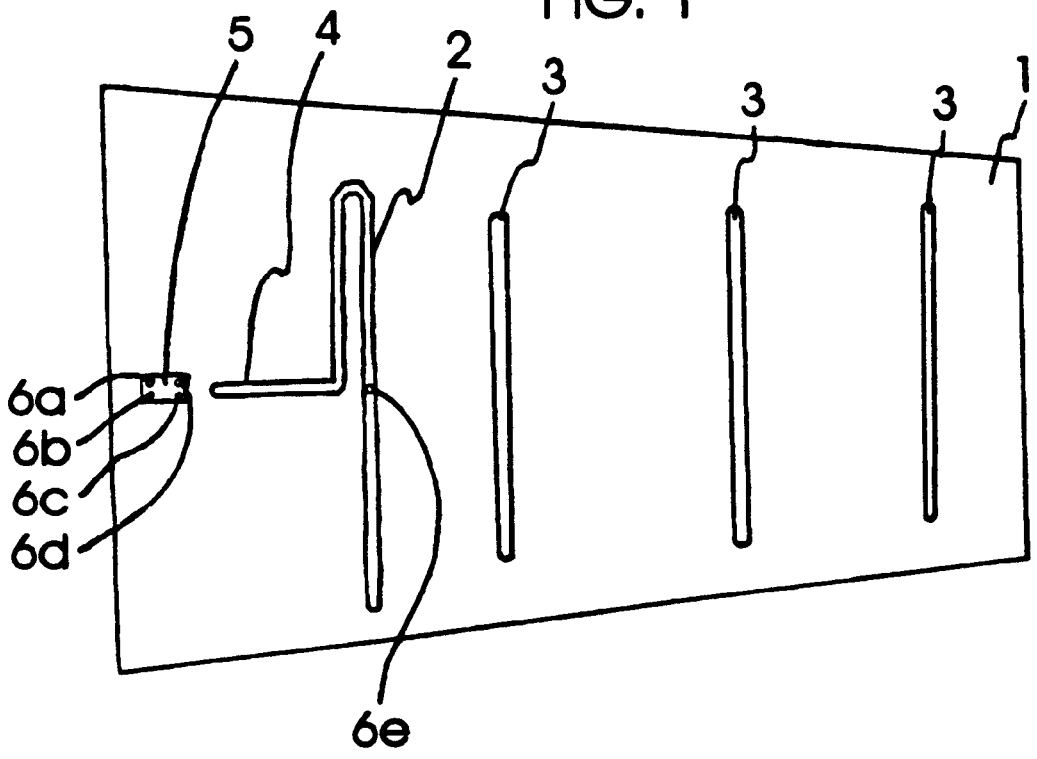
FIG. 1 is a top view of an embodiment of an antenna of the present invention showing the printed driven element, director elements, grounding pad, and microstrip transmission line forming part of the active element.

FIG. 1 is a top view of an embodiment of an antenna showing the printed circuit board (PCB) 1 upon which various other elements are printed. The antenna shown in FIG. 1 may be, for example, a 2.4 GHz antenna. A driven element 2, which may be a J element, is printed thereon. Director elements 3 and transmission line 4 are also printed on PCB 1. A top grounding pad 5 includes interconnects 6*a*–6*d*, which pass through PCB 1 as discussed in greater detail below. An interconnect 6*e* couples to a point of driven element 2.

Figure 2:
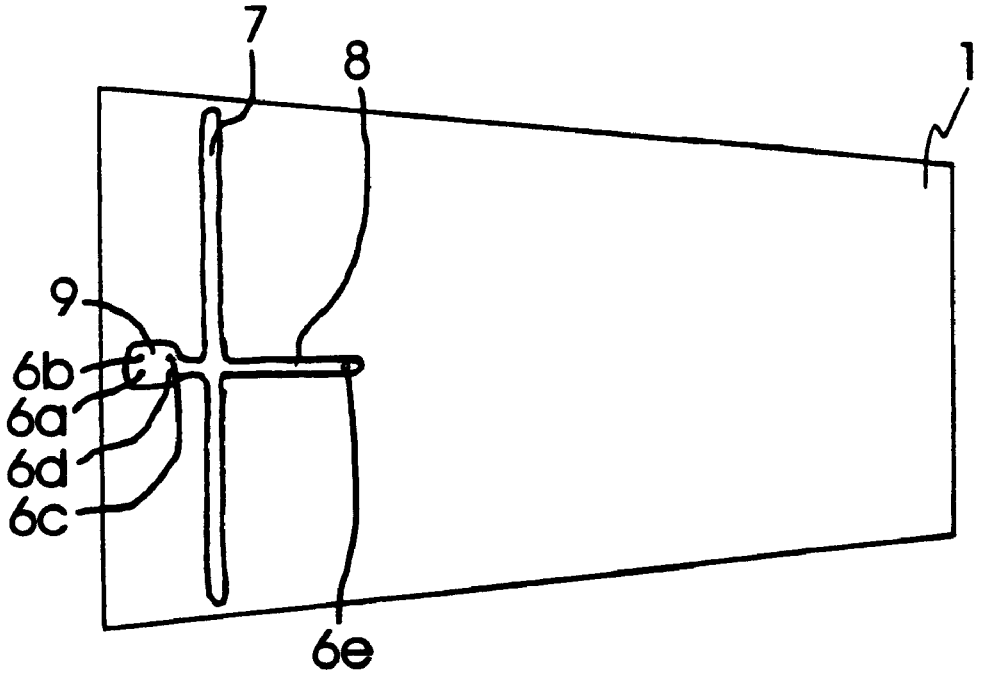
FIG. 2 is a bottom view of the embodiment of the present invention of FIG. 1, showing a printed reflector, bottom grounding pad with plated through hole interconnects to the top grounding pad, and a ground plane forming part of the transmission line.
Figure 3:
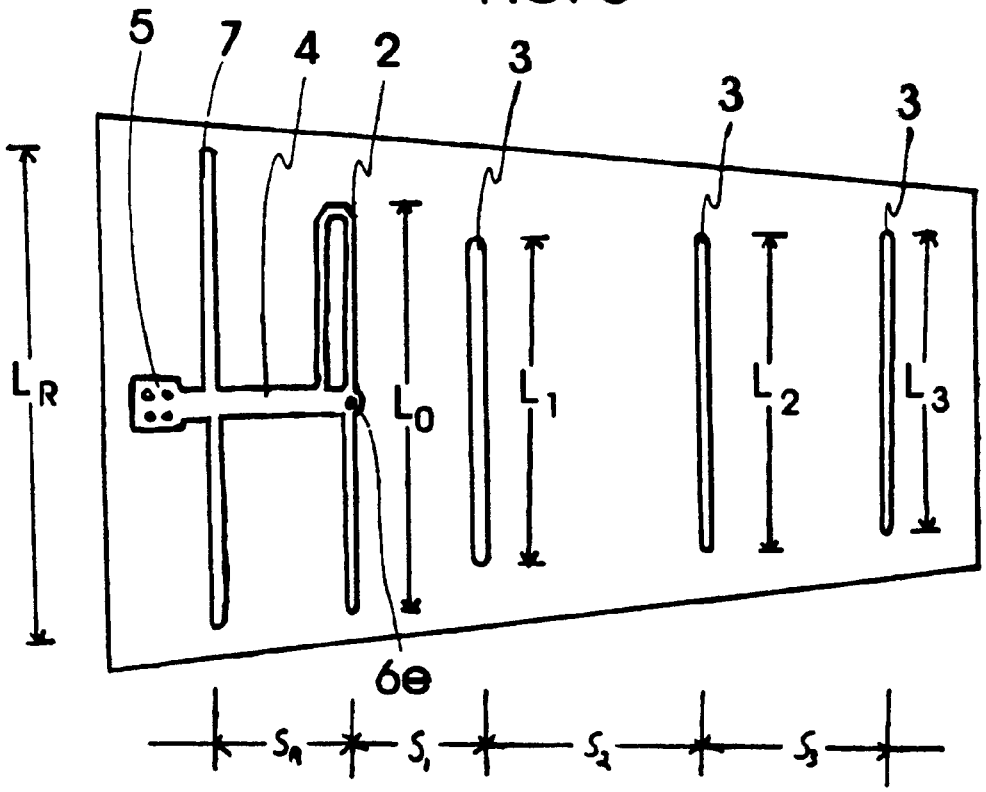
FIG. 3 is a superimposed view of the overlapping areas of both the top and bottom printed elements of the embodiment of the present invention, shown in FIGS. 1 and 2.

FIG. 2 is a bottom view of the antenna of the present invention showing a printed reflector 7, bottom grounding pad 9 with plated through hole interconnects 6*a*–6*d* to the top grounding pad 5, and a ground plane 8 forming part of the transmission line 4. Interconnects 6*a*–6*d* shown in FIG. 2 are preferably realized by forming plated through holes in apertures of PCB 1. FIG. 3 shows a superimposed view of the overlapping areas of both the top and bottom printed elements of PCB 1, shown in FIGS. 1 and 2.

PCB 1 may be made, for example, from 0.062" thick Fiberglass material having 1 oz copper cladding on both sides and a dielectric constant of approximately 4.0. However, any suitable dielectric material and/or conductor cladding may be used. Circuit runs 2–5 and 7–9 are formed on the printed circuit board by etching away portions of the copper cladding. The plated through holes 6*a*–6*e* may be formed by a drilling and plating process. The plating process forms interconnects between the top and bottom circuits by coating the insides of the drilled apertures with a conductive material, such as copper.

As shown in FIG. 2, ground plane 8 may be electrically grounded via ground pad 9 thereby forming the groundplane of microstrip transmission line 4. While the center point of reflector 7 is electrically grounded via its connection to groundplane 8, the remaining outer periphery of reflector 7, distally located relative to ground plane 8, reflects electromagnetic waves. The ground portion of the reflector 7 is formed in an electrical null which does not adversely affect its performance. Thus, a portion of the microstrip transmission line is formed as a portion of the reflector. Further, as can be seen in FIG. 1, the driven element 2 is also grounded at its electrical null point via plated through hole 6*e*. The ground connection at 6*e* tends to enhance performance of the printed circuit antenna by providing electrical stability and predictable performance.

Figure 5:
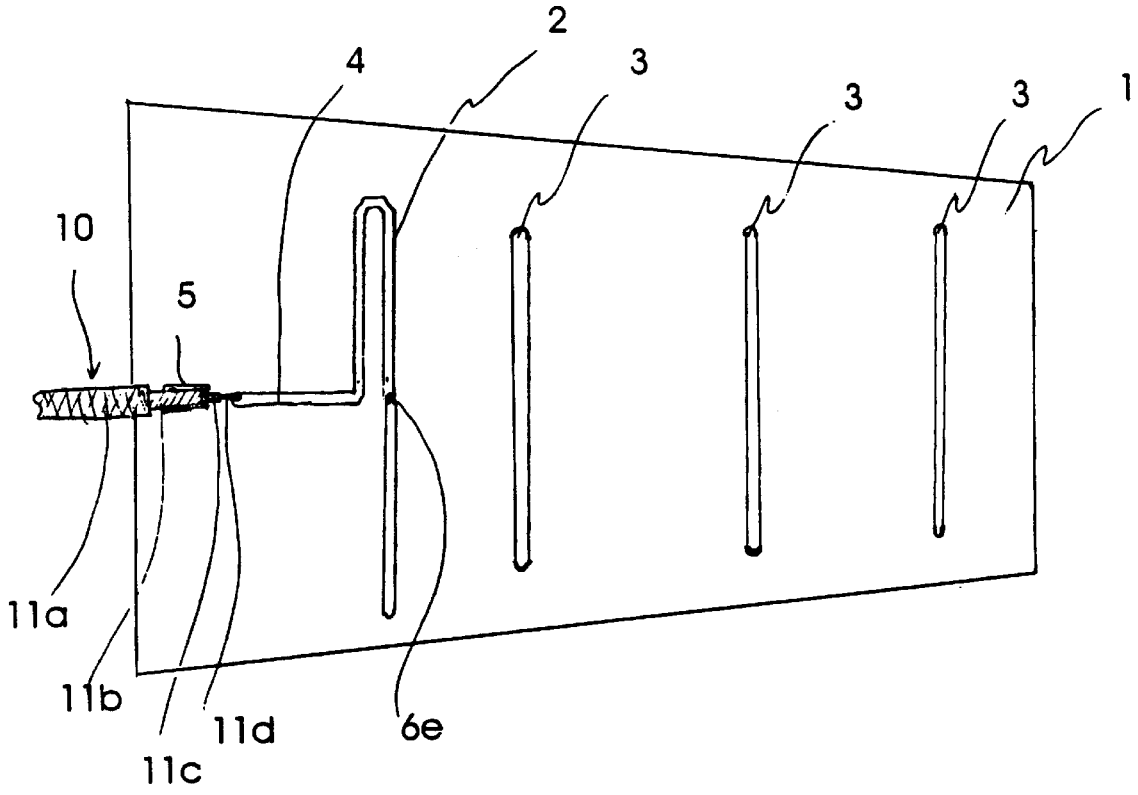
FIG. 5 is a top view of the embodiment of the present invention showing the attachment of a coaxial cable to the driven element.
Figure 6:
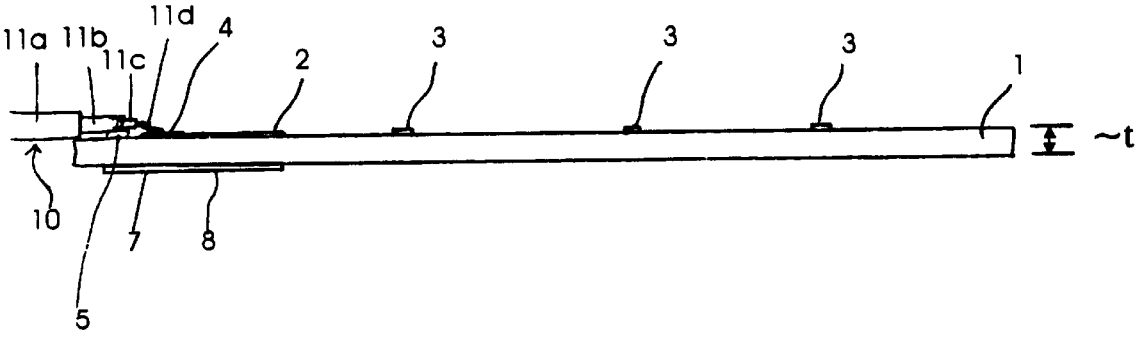
FIG. 6 is a side view of the embodiment of the present invention showing the attachment of a coaxial cable to the driven element.
Figure 7:
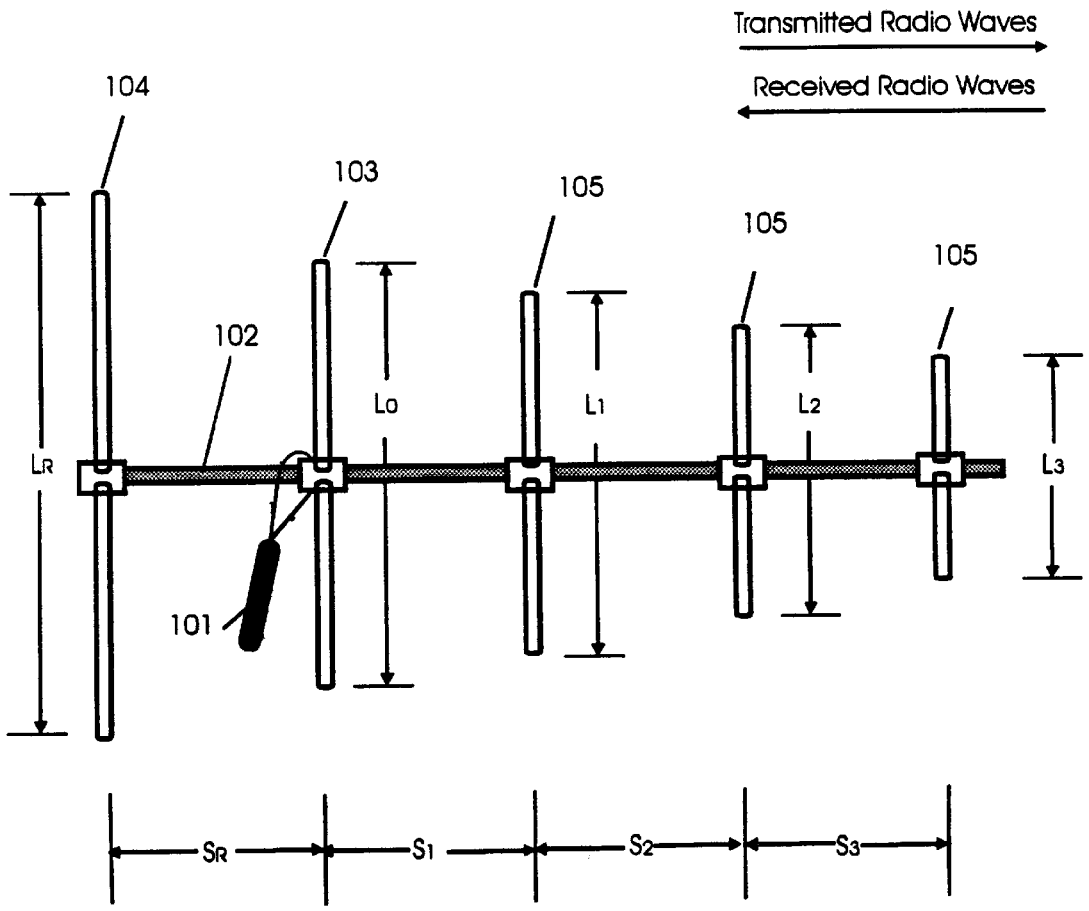
FIG. 7 (Prior Art)
FIG. 7 is a top view of a conventional Yagi-Uda antenna.

FIGS. 5 and 6 show a coaxial cable 10 having an outer insulator 11*a*, ground mesh layer 11*b*, inner insulation layer 11*c*, and center conductor 11*d*. The coaxial cable 10 may have a characteristic impedance of 50 Ω. Coaxial cable 10 is stripped to expose the center conductor 11*d* and the grounded mesh layer 11*b*. Ground mesh layer 11*b* is soldered to ground pad 5 of PCB 1. As a result, the ground pad 5 is electrically grounded to the ground mesh layer 11*b* via plated lips through holes 6*a*–6*d*. Center conductor 11*d* is soldered to the proximal end of microstrip transmission line 4.

To ensure a strong connection to PCB 1, the ground mesh 11*b* of the coaxial cable 10 can be soldered to a relatively large ground pad. This alleviates any flexing of the cable during manufacturing or use that could weaken the solder joint and cause intermittent open circuits or increased resistance at the solder joint, both of which will adversely affect antenna performance. However, a large ground pad with the coaxial grounding mesh soldered to it may cause unpredictable antenna performance if placed close to portions of the driven element or other elements. For example, coaxial cables often have small variations in the dimensions of the stripped portion. The ground mesh layer can become easily frayed, or the length of the exposed center conductor may vary relative to the cut end of the grounding mesh. These small deviations in the shape and size of the stripped portion of the coaxial cable can drastically change the antenna parameters. This requires that more precise stripping and placement of the coaxial cable which increases cost. Furthermore, the antenna can experience a de-tuning effect if the feedline passes too close to other elements.

It is therefore often desirable to feed the driven element 2 with the above described printed microstrip transmission line 4 rather than directly with coaxial cable 10. Line width of the trace is chosen to form a transmission line having the same impedance as the coaxial cable 10. The printed transmission line 4 leading up to the driven element 2 can be designed to be uniformly and repeatably manufactured, thus minimizing the electromagnetic effects on the driven element 2. Additionally, because of its distance from the driven element 2, the stripped portion of the coaxial cable does not require a high degree of precision cutting and placement thereby reducing production costs.

In a preferred embodiment, the inclusion of the short transmission line 4 requires that the reflector 7 be formed on the bottom side of the PCB 2 so as to avoid contact between ground pad 5 and the transmission line 4. Thus, the distance Sr as shown in FIG. 3 between the driven element 2 and the reflector element 7 can be selectively varied without causing the reflector 7 to make electrical contact with the microstrip transmission line 4, thereby providing greater design freedom.

Figure 4:
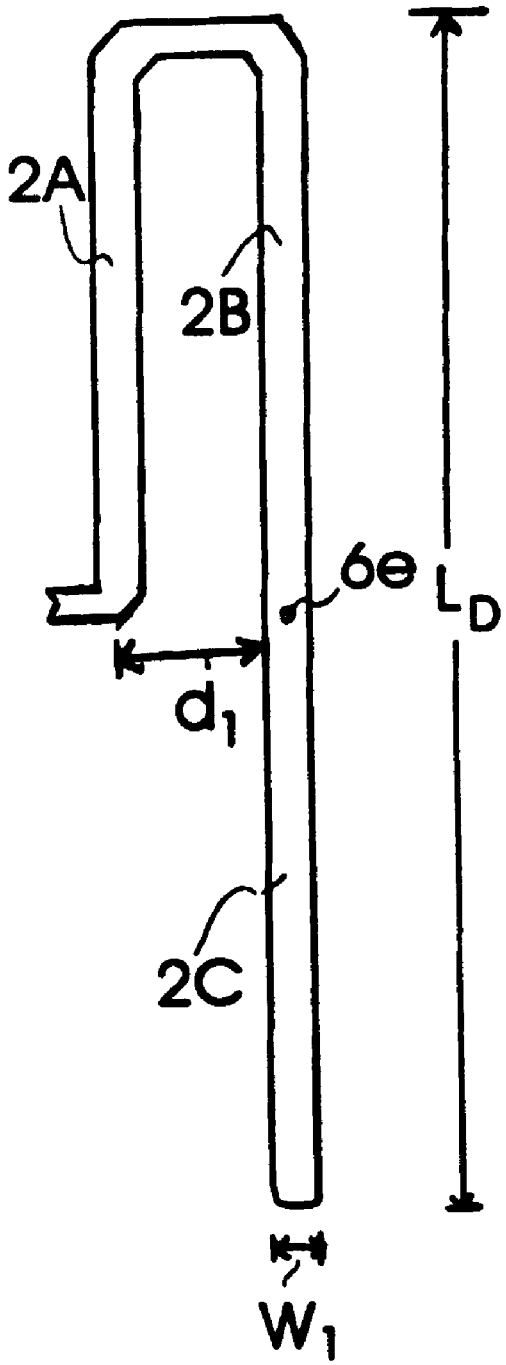
FIG. 4 is a detailed top view of the driven element shown in FIG. 1.

As shown in FIGS. 3–4, J element 2 is comprised of portions 2A–2C. Portion 2A is separated from portion 2B by distance d1. Portions 2B and 2C each have a length of ½ Ld. Line widths w1 are approximately 0.2" in this embodiment. The J element 2 has a characteristic impedance of 150 ohms at 2.4 GHz without additional loading. Therefore, dimensions Sr, Sd, S1, S2, S3, Lr, Ld, L1, L2, L3 and other parameters of the antenna design must be chosen such that the loading effects of the parasitic elements and the dielectric printed circuit board substrate on the driven element cause the apparent impedance of the driven element 2 to be approximately equal to the characteristic impedance of the coaxial cable 10. Further, impedance must be achieved while maintaining sufficient directional gain and minimizing overall antenna size.

In the case of the 2.4 GHz antenna design of a preferred embodiment, the dimensions are chosen as shown in Table 1.

TABLE 1

| | |
|---|---|
| Sr = .4" | Lr = 2.0" |
| S1 = .5" | Ld = 1.65" |
| S2 = .9" | L1 = 1.5" |
| S3 = .75" | L2 = 1.4" |
| | L3 = 1.35" |

The performance of the Yagi antenna is based on many factors. Overall length of the antenna, length of the antenna elements, and spacing between the antenna elements are the most important factors. In theory, there are a large number of solutions of element spacings, lengths, and diameters that will produce a good antenna design. Modem Numerical Electromagnetic Code (NEC) software provides solutions that perform to within a few percentage points of what is theoretically possible for the antenna. Adding elements also has a significant effect on antenna performance, particularly directional gain. For example, in a typical application, a Yagi antenna consisting of one driven element, one reflector element, and one director element concentrates radio wave energy by a factor of 5. A Yagi antenna consisting of one driven element, one reflector element, and 3 director elements concentrates the radio wave energy by a factor of 10.

In the present invention, the dimensions of the Yagi antenna are determined so that the overall size of the antenna is reduced. Further, the spacing and length of each element is chosen so that the apparent impedance of the driven element is approximately equal to the impedance of the feed cable. The design procedures for calculating the antenna dimensions of the present invention can be carried out in a three phase process.

First, the theoretical spacing and length of the Yagi elements are calculated based upon a selected set of input parameters using NEC software or other available software capable of calculating the electromagnetic effects of metallic structures.

Second, after calculating the appropriate lengths and spacings of the Yagi elements in free space, the lengths of the Yagi elements are reduced by a compensating factor of 72%, and the spacing of the elements from the element nearest the driven element is reduced by a factor of 85%. The length and spacing factors compensate for the effects of using flat elements and the dielectric constant of the dielectric material.

Finally, a set of approximately 10–20 test models are manufactured based upon these dimensions, each test model having the element spacings and lengths varied by approximately 1%–2%. Each antenna is tested for directivity and impedance. The test antenna with the best impedance match (an impedance match close to the impedance of the coaxial cable) and directional gain is selected.

NEC modeling software is able to predict how electromagnetic waves will interact with metallic structures. In particular, NEC software can predict the performance of antenna structures. Without the use of modeling software such as NEC, hundreds of thousands of test antennas would have to been necessary to develop the antenna of the present invention. Even with the solutions developed by the NEC software, approximately 10–20 test antennas were constructed to optimize factors that could not be computer modeled in NEC.

There are a number of factors, however, that can not be properly computer modeled in NEC. First, the normal Yagi style antenna is constructed from sections of wire. As such, NEC assumes that all elements are round sections of wire, and produces results based upon that assumption. Printed circuit board antennas, however, use extremely thin layers of copper laminated to a dielectric substrate. Therefore, a compensation factor had to be developed that converted the NEC results based upon round elements to an equivalent dimension that accounted for the flat elements of a printed circuit board.

Furthermore, the normal Yagi antenna is constructed in free space, i.e. the elements are intentionally kept away from all other materials. In a printed circuit board antenna, the antenna elements are in intimate contact with the board substrate, typically Fiberglass for low cost PCB materials. This combination of the substrate material and the flattening of the elements resulted in a loading effect and reduced the length of each element by a factor of 72% from the "free space" equivalent antenna. The 72% compensation factor is applicable for a 0.062" thick dielectric substrate with a dielectric constant of 4.0. For thicker substrate materials, the compensation factor should be reduced by several percent. For higher dielectric materials, the compensation factor should be further reduced by several percent.

Additionally, while the individual elements are in intimate contact with the board substrate, the electromagnetic wave launched along the structure is only partially affected by the substrate material. Thus, the compensating factor for Yagi element spacing is less than the compensating factor for element length. A spacing factor of 85% vs. the computer modeled free space equivalent was determined through extensive prototype testing and is applicable for a 0.062" thick dielectric substrate with a dielectric constant of 4.0. For thicker substrate materials, the compensation factor should be reduced by several percent. For higher dielectric materials, the compensation factor should be further reduced by several percent.

The partial folded J element used as the driven element in the present invention has an impedance of 150 Ω. Therefore, a compensation factor must be used when modeling the antenna design using NEC. For example, due to the 150 Ω impedance of the J element, if an apparent impedance of 50 Ω is desired, an impedance of 50/3 Ω, or approximately 17 Ω, should be specified in the NEC model.

The following initial parameters are input into the NEC model:

λ=wavelength

Lr=reflector length=0.55 λ

Ld=halfwave dipole length=0.5 λ

L1=first director length=0.45 λ

Sr=spacing between the reflector and the halfwave dipole=0.45 λ

S1=spacing between the halfwave dipole and the first director element=0.45 λ

NEC calculates the input impedance and directional gain for the input parameters. The software then slightly varies L1 and S1 in an optimizing routine, each time calculating the directional gain and the apparent input impedance of the driven element. The modeling software performs multiple iterations of the impedance and gain calculations until the directional gain is maximized. A table of the calculated results are generated as the values are computed. Based on the table, a length and spacing of the first director element is selected based on a proper balance of the following criteria:

(1) the impedance Ωd must be close to the impedance Ωc of the input cable.

(2) the directional gain (Gd) must be close to a maximum theoretical value.

(3) the impedance and gain must not vary significantly with small changes in the element length and spacing.

With respect to the third requirement, it is noted that the optimum solution to a particular antenna design is sometimes very sensitive to minor variations in antenna dimensions. For example, for some solutions, a slight movement in element spacing or length can change the antenna performance from optimum to almost non-functional. This is particularly problematic in mass production where part-to-part variations in antenna performance must be kept to a minimum. Therefore, to avoid costly high tolerance manufacturing, low yield, or individual antenna testing, the to design solution must allow for some variation in element length and spacing that does not cause extreme performance variation.

Once the length L1 and spacing S1 are chosen, L1 is reduced by the compensation factor 72% (0.72×L1) and S1 is reduced by the compensation factor 85% (0.85×S1). Thereafter, a series of approximately 10–20 test antennas are built having varying spacings and lengths of the first director elements. The variation is done in increments of approximately 1%. Furthermore, the test antennas are built using the partial folded J element. The antennas are measured and the antenna having the best balance between directional gain and input impedance is selected. The resulting design will have excellent directivity and an apparent impedance close to that of the coaxial feed cable.

To produce Yagi antennas having additional director elements, the results L1 and S1 are entered back into the NEC model. The additional input parameters S2=0.45 λ and L2=0.45× are entered into the model. S2 and L2 are the spacing and length of the second director element, respectively. The same procedure is followed whereby the NEC software varies S2 and L2 until the directional gain is optimized. As before, based on the table of results, a length L2 and spacing S2 of the second director element is selected based on a balance of the following criteria:

(1) the impedance Ωd must be close to the impedance Ωc of the input cable.

(2) the directional gain (Gd) must be close to a maximum theoretical value.

(3) the impedance and gain must not vary significantly with small changes in the element length and spacing.

The compensation factors are applied and test models are built using the J element and the final design is selected. Additional director elements 3, 4, 5, etc. may be added using the same procedure. While antennas having up to 11 elements have been built using this method, there is no theoretical limit to the maximum number of elements that can be used. Each additional element will increase the directional gain of the antenna, while, of course increasing the overall size of the antenna. Once designed, the antenna can be modified to perform at any other band by scaling its dimensions in proportion to the desired frequency band. For example, if the desired wavelength is doubled, the element widths, spacings, and dielectric thickness of the substrate should also be doubled. Further, one skilled in the art could also produce a variety of antennas having the characteristic of the present invention by using the iterative design procedure described herein.

Figure 8A:
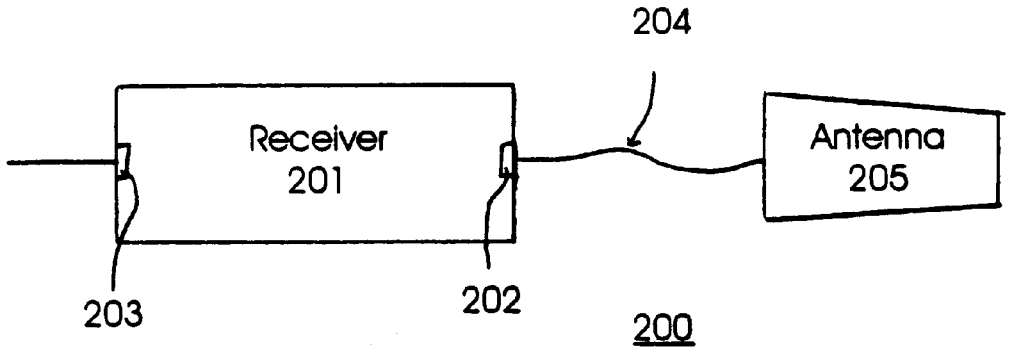
FIG. 8A is a block diagram of an embodiment of a radio receiver system.
Figure 8B:
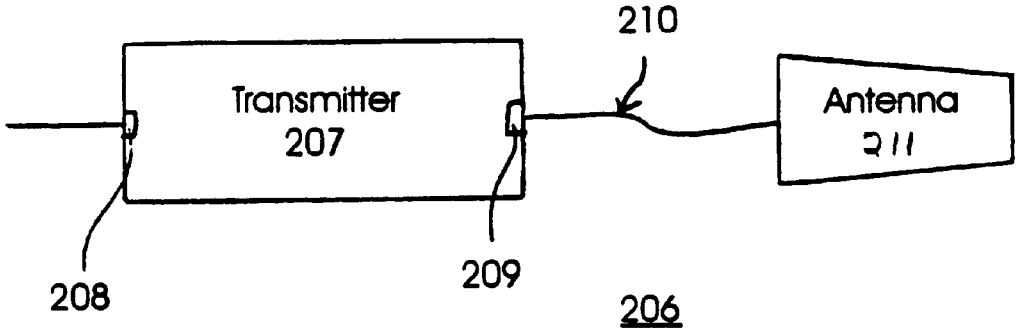
FIG. 8B is a block diagram of an embodiment of a transmitter system.

As shown in FIGS. 8A and 8B, a radio receiver system 200 can be produced using a radio receiver 201 having an input 202 and an output 203, and whose input 202 is coupled to the antenna 205 disclosed herein via a coaxial cable 204 or by other methods. Furthermore, a transmitter system 206 can be produced using a transmitter 207 having an input 208 and an output 209, and whose output 209 is coupled to the antenna 211 disclosed herein via a coaxial cable 210 or by other methods. It is often necessary to design the receiver system or transmitter system with an antenna whose performance characteristics advantageously meet the needs of the system requirements. For example, using a higher gain antenna in a receiver or transmitter system can reduce the cost and complexity of a radio receiver or transmitter. Also, a more compact antenna allows for an overall smaller form factor for the receiver system or transmitter system. Thus, well known transmitter and receiver designs can be combined with an antenna disclosed herein to produce receiver or transmitter systems with specific performance requirements.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A Yagi antenna, comprising:

an insulative circuit board having a proximal end and a distal end;

a J-shaped driven element having an impedance Ωd and being printed on a top surface of the circuit board, wherein the J-shaped driven element comprises a short portion, a long portion that is twice as long as the short portion, and a connecting portion connecting the short portion and the long portion, the short and long portions being parallel to each other, and wherein a mid-point of the long portion of the J-shaped driven element is grounded;

one or more director elements printed on a top surface of the circuit board at a position located between the distal end of the circuit board and the J-shaped driven element;

a reflector element printed on a bottom surface of the circuit board at a position located between the proximal end of the circuit board and the J-shaped driven element;

a microstrip transmission line printed on the circuit board, the microstrip transmission line having a proximal end, a distal end, and an impedance Ωw, the distal end of the microstrip transmission line being electrically connected to the J-shaped driven element; and a cable having an impedance Ωc, the cable being electrically connected to the proximal end of the microstrip transmission line, wherein the impedance Ωc matches the impedances Ωd and Ωw.

2. The Yagi antenna according to claim 1, wherein the microstrip transmission line includes a signal line printed on the top surface of the circuit board and a ground plane printed on the bottom surface of the circuit board, the mid-point of the long portion of the J-shaped driven element is grounded to the ground plane via an interconnection between the top surface and the bottom surface of the circuit board, and the ground plane is attached to a second ground pad printed on the bottom surface of the circuit board.

3. The Yagi antenna according to claim 2, wherein the reflector element is grounded at its mid-point by the ground plane.

4. The Yagi antenna according to claim 3, wherein a first ground pad is printed on the top surface of the circuit board for attaching the cable.

5. The Yagi antenna according to claim 4, wherein the cable is a coaxial cable and includes a signal wire, an inner insulator, a ground mesh, and an outer insulator, the inner insulator surrounding the signal wire, the ground mesh surrounding the inner insulator, and the outer insulator surrounding the ground mesh, wherein the ground mesh is soldered to the first ground pad and the signal wire of the coaxial cable is soldered to the signal line at the proximal end of the transmission line.

6. The Yagi antenna according to claim 5, wherein the second ground pad is electrically connected to the first ground pad of the top surface of the circuit board via interconnections.

7. The Yagi antenna according to claim 6, wherein the interconnections are plated through holes.

8. A radio receiver system, comprising:

a radio receiver having an input and an output;

an insulative circuit board having a proximal end and a distal end;

a J-shaped driven element having an impedance Ωd and being printed on a top surface of the circuit board, wherein the J-shaped driven element comprises a short portion, a long portion that is twice as long as the short portion, and a connecting portion connecting the short portion and the long portion, the short and long portions being parallel to each other, and wherein a mid-point of the long portion of the J-shaped driven element is grounded;

one or more director elements printed on the top surface of the circuit board at a position located between the distal end of the circuit board and the J-shaped driven element;

a reflector element printed on the circuit board at a position located between the proximal end of the circuit board and the driven element;

a microstrip transmission line printed on the circuit board, the microstrip transmission line having a proximal end, a distal end, and an impedance Ωw, the distal end of the microstrip transmission line being electrically connected to the J-shaped driven element; and a cable having a first end, a second end, and an impedance Ωc, wherein the first end is electrically connected to the proximal end of the microstrip transmission line, and the second end is electrically connected to the input of the receiver, and wherein the impedance Ωc matches the impedances Ωd and Ωw.

9. The radio receiver system according to claim 8, wherein the microstrip transmission line includes a signal line printed on the top surface of the circuit board and a ground plane printed on the bottom surface of the circuit board, the mid-point of the long portion of the J-shaped driven element is grounded to the ground plane via an interconnection between the top surface and the bottom surface of the circuit board, and the ground plane is attached to a second ground pad printed on the bottom surface of the circuit board.

10. The radio receiver system according to claim 9, wherein the reflector element is grounded at its mid-point by the ground plane.

11. The radio receiver system according to claim 10, wherein a first ground pad is printed on the top surface of the circuit board for attaching the cable.

12. The radio receiver system according to claim 11, wherein the cable is a coaxial cable and includes a signal wire, an inner insulator, a ground mesh, and an outer insulator, the inner insulator surrounding the signal wire, the ground mesh surrounding the inner insulator, and the outer insulator surrounding the ground mesh, wherein the ground mesh is soldered to the first ground pad and the signal wire of the coaxial cable is soldered to the signal line at the proximal end of the transmission line.

13. The radio receiver system according to claim 12, wherein the second ground pad is electrically connected to the first ground pad of the top surface of the circuit board via interconnections.

14. The radio receiver system according to claim 13, wherein the interconnections are plated through holes.

15. A transmitter system, comprising:

a transmitter having an input and an output;

an insulative circuit board having a proximal end and a distal end;

a J-shaped driven element having an impedance Ωd and being printed on a top surface of the circuit board, wherein the J-shaped driven element comprises a short portion, a long portion that is twice as long as the short portion, and a connecting portion connecting the short portion and the long portion, the short and long portions being parallel to each other, and wherein a mid-point of the long portion of the J-shaped driven element is grounded;

one or more director elements printed on the top surface of the circuit board at a position located between the distal end of the circuit board and the driven element;

a reflector element printed on a bottom surface of the circuit board at a position located between the proximal end of the circuit board and the J-shaped driven element;

a microstrip transmission line printed on the circuit board, the microstrip transmission line having a proximal end, a distal end, and an impedance Ωw, the distal end of the microstrip transmission line being electrically connected to the J-shaped driven element; and a cable having a first end, a second end, and an impedance Ωc, wherein the first end is electrically connected to the proximal end of the microstrip transmission line, and the second end is electrically connected to the output of the transmitter, and wherein the impedance Ωc matches the impedances Ωd and Ωw.

16. The transmitter system according to claim 15, wherein the transmission line includes a signal line printed on the top surface of the circuit board and a ground plane printed on the bottom surface of the circuit board, the mid-point of the long portion of the J-shaped driven element is grounded to the ground plane via an interconnection between the top surface and the bottom surface of the circuit board, and the ground plane is attached to a second ground pad printed on the bottom surface of the circuit board.

17. The transmitter system according to claim 16, wherein the reflector element is grounded at its mid-point by the ground plane.

18. The transmitter system according to claim 17, wherein a first ground pad is printed on the top surface of the circuit board for attaching the cable.

19. The transmitter system according to claim 18, wherein the cable is a coaxial cable and includes a signal wire, an inner insulator, a ground mesh, and an outer insulator, the inner insulator surrounding the signal wire, the ground mesh surrounding the inner insulator, and the outer insulator surrounding the ground mesh, wherein the ground mesh is soldered to the first ground pad and the signal wire of the coaxial cable is soldered to the signal line at the proximal end of the transmission line.

20. The transmitter system according to claim 19, wherein the second ground pad is electrically connected to the first ground pad of the top surface of the circuit board via interconnections.

21. The transmitter system according to claim 20, wherein the interconnections are plated through holes.

* * * * *